United States Patent [19]

McNew

[11] 4,185,760

[45] Jan. 29, 1980

[54] SYSTEM FOR FEEDING ELONGATED DOCUMENTS TO REPRODUCING APPARATUS

[76] Inventor: Thomas A. McNew, 5909 N. Harvard Dr., Oklahoma City, Okla. 73122

[21] Appl. No.: 907,922

[22] Filed: May 22, 1978

[51] Int. Cl.[2] ..... B65H 17/42; B65H 17/46

[52] U.S. Cl. ..... 226/109; 242/85; 355/3 SH

[58] Field of Search ..... 226/109, 110; 242/85, 242/128, 129.6; 355/18, 13, 75, 3 SH

[56] References Cited

U.S. PATENT DOCUMENTS

| | | | |
|---|---|---|---|
| 2,851,267 | 9/1958 | Davidson | 226/109 X |
| 3,299,772 | 1/1967 | Walter | 355/18 |
| 3,383,071 | 5/1968 | Godson | 242/85 X |
| 4,086,007 | 4/1978 | Smith | 355/3 SH |

*Primary Examiner*—Edward J. McCarthy
*Attorney, Agent, or Firm*—William R. Laney

[57] ABSTRACT

An apparatus for concurrently feeding elongated documents and substantially correspondingly sized copy paper to a reproducing apparatus which includes a collapsible, vertically extending A-frame having a pair of opposed, divergent sides each of inverted U-shape, and pivotally interconnected at the tops thereof. One of the sides of the A-frame journals a horizontal, paper roll-supporting element, and the other side of the frame carries a horizontal paper guide bar. At the upper side of the A-frame, the frame detachably supports one end of an elongated document-supporting tray which is adapted to support and feed a collapsed and folded original fanfold document of multiple superimposed layers. The other end of the document-supporting tray is aligned with feed rolls of a reproducing apparatus used to feed the document to be copied or reproduced to the reproduction section of the apparatus. The A-frame is also positioned to cooperate with other feed rolls within the reproducing apparatus for the purpose of passing to these feed rolls, an elongated strip of paper upon which the indicia from the fanfold original document is to be reproduced.

15 Claims, 7 Drawing Figures

SYSTEM FOR FEEDING ELONGATED DOCUMENTS TO REPRODUCING APPARATUS

BACKGROUND OF THE INVENTION

1. Field of the Invention

This invention relates to material handling devices, and more particularly, to paper feeding structures used for continuously feeding an elongated strip-type paper, carrying indicia thereon, to a reproducing machine, concurrently with the feeding from the apparatus of the invention to such machine of an elongated strip of paper upon which the indicia are to be reproduced.

2. Brief Description of the Prior Art

In recent years, great progress and innovation has occurred in the field of document reproduction and copying. The xerographic process and other dry methods of high-speed copying have enabled substantial and significant advances to be attained in information dissemination, storage and retrieval, and have immensely accelerated the work of clerical personnel in various capacities. For the most part, the types of copying apparatus or devices which have been developed are based upon the frequent need to copy letter and legal-size documents which are supplied and used in standardized sizes, usually not exceeding about 14 inches in length and about 10 or 11 inches in width.

As the most widely used reproducing machines operate, original imprinted documents of the described sizes are consecutively fed to a copying location within the machine by means of certain feed rollers, and concurrently, one or more sheets of paper upon each of which the information appearing on the document is to be copied are synchronously fed to the copying location where the reproduction of the indicia on the copies is caused to occur. With these types of machines, it is cumbersome, difficult and time consuming to effectively reproduce documents which are of significantly greater length than the more conventional and widely encountered documents, and in such cases it is often necessary to paste-up a series of conventionally sized sheets upon which segments of the elongated original document have been reproduced, in order to simulate the long original document. Examples of the types of inordinately long documents which, on occasion, are thus reproduced are galley proofs of manuscripts, oil and gas well logs, electrocardiograms, strip charts made on various types of continuous recorders, adding machine tapes as used by accountants and the like. Although certain xerographic reproducing machines have recently been devised which will permit copies of especially long documents to be made, the manner in which the reproduced copies are formed, discharged and then must be assembled has not been optimum. Particularly has this been true in the case of elongated original documents of the fanfold type—that is, documents which are folded or pleated in accordion style along a number of fold lines spaced longitudinally of the document and extending transversely thereacross. Since exact correspondence in indicia matching is essential in the reproducing of such long charts as well logs or electrocardiograms, the practice has often been to reproduce these documents by much more expensive procedures, such as blueprinting, which enable the entire document to be precisely reproduced by a one-shot process.

One type of patent which has been recently proposed for feeding fanfolded documents to a photographically reproducing machine is Walters U.S. Pat. No. 3,299,772. More recently, Hichcock et al. U.S. Pat. No. 3,443,554 depicts a xerographic reproducing apparatus in which fanfold paper, such as a computer printout, is fed from a paper tray into the machine, and is carried across the platen in a series of incremental movements which are synchronized with the feeding of a plurality of sheets of paper upon which segments of the document are to be reproduced. A shortcoming of this apparatus is, of course, that the several segments upon which the elongated fanfold document is reproduced must then be pasted-up or assembled to correspond with the original in overall length, and by appropriate registration of the printing on the segments so as to correspond with that upon the document which is the original to be reproduced.

BRIEF DESCRIPTION OF THE PRESENT INVENTION

The present invention is a device which permits an elongated strip of paper to be continuously fed to a reproducing apparatus for the purpose of reproducing thereon, indicia carried by an elongated original document which is concurrently fed continuously to the reproducing apparatus from the device of the invention.

Broadly described, the device of the invention comprises a collapsible, vertically extending A-frame which includes a pair of opposed, divergent sides which are pivotally connected to each other at their upper ends and have their lower ends horizontally spaced from each other. One of the sides of the A-frame carries a paper roll-supporting element upon which the paper on which the copy is to be made is supported in the form of a roll. This side of the A-frame also carries a horizontally extending paper guide bar over which the paper to be reproduced is passed prior to passage through feed rollers carried in the reproducing apparatus to which the paper is fed. The device of the invention further includes an elongated paper feed tray which has one end detachably engaged with the upper side of the A-frame, and the other end supported adjacent a feeding mechanism carried on the reproducing apparatus. The feed tray is adapted by size and geometry to support a pair of elongated documents carrying indicia to be reproduced, with the documents placed on the tray in a fanfold configuration in which a plurality of reverse folds are formed transversely across each of the documents, and a plurality of superimposed layers of the document are thus formed in stacked relation to each other.

In another aspect, the invention comprises a device for concurrently feeding an elongated strip of paper, stored at the feed station in roll form, to a reproducing apparatus concurrently with the feeding to such apparatus of one or a pair of elongated documents carrying indicia to be copied or reproduced on the copy paper being concurrently fed to the apparatus, and in combination with such device, apparatus for applying a feeding force to both the documents to be reproduced and to the paper upon which reproduction is to occur, and mechanism for copying indicia from the original document upon the paper to which the indicia are to be transferred.

An important object of the present invention is to provide an apparatus which can produce a very long copy of an elongated document, with the copy produced corresponding substantially in length with the original document.

A further object of the invention is to provide a relatively simple, mechanically sturdy device for concurrently and continuously feeding two very long strips of paper to a reproducing or copying apparatus by which indicia carried on one of the strips may be transferred by a xerographic or other copying process in exact correspondence to the other strip, with the documents corresponding substantially in their overall length.

A further object of the invention is to provide a device which can be used for concurrently feeding and copying two relatively narrow, elongated strip form documents, such as well logs, to a reproducing or copying apparatus, and simultaneously feeding to the same copying apparatus, one or more elongated strips of paper to which indicia is to be transferred from the concurrently fed original strip form documents.

A further object of the invention is to provide a compact, easily stored paper feeding device which can be folded out to its operative position and used in conjunction with a xerographic or other copying system for feeding both the copy paper and the original document to the copying system simultaneously and at substantially the same speed.

Additional objects and advantages of the invention will become apparent as the following detailed description of the invention is considered in conjunction with the accompanying drawings which illustrate certain preferred embodiments of the invention.

GENERAL DESCRIPTION OF THE DRAWINGS

FIG. 6 is a view similar to FIG. 5 but illustrating a recess or slot used on the other side of the A-frame for receiving the other end of a paper-supporting element which has one of its ends positioned in the cavity depicted in FIG. 5.

DETAILED DESCRIPTION OF PREFERRED EMBODIMENTS OF THE INVENTION

Figure 1:
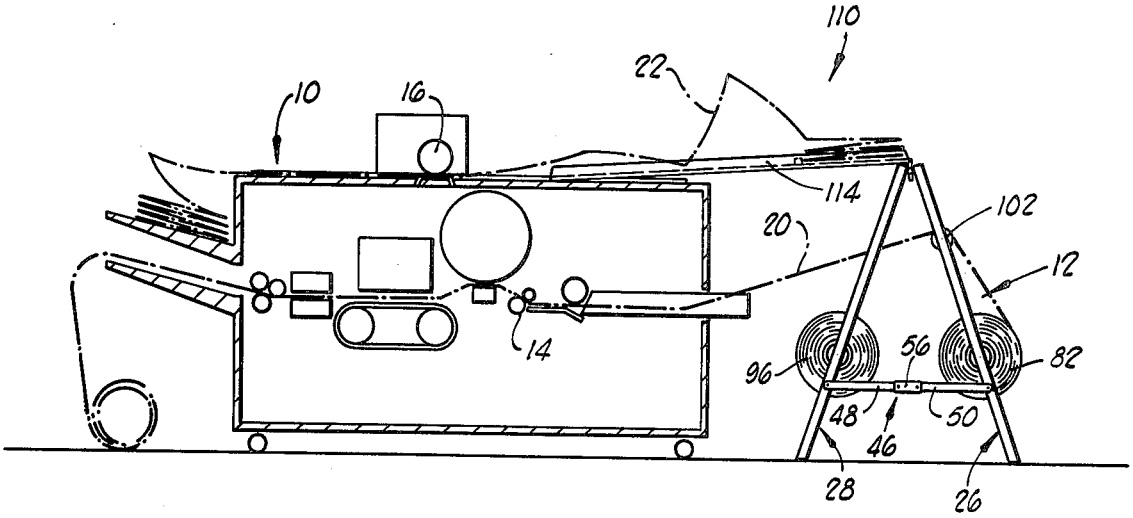
FIG. 1 is a side elevation view of a system incorporating the inventive concepts of the present invention in a novel combination, and including a device for concurrently feeding to a copying machine, paper to which indicia is to be transferred in a copying process, and an original document. A portion of the apparatus is shown in section and schematically.

Referring to the drawings, a system using the principles of the present invention is illustrated in FIG. 1 and includes a reproducing or copying apparatus 10 and a document feeding device 12. The reproducing apparatus 10 in the illustrated embodiment is a typical xerographic process machine, and includes a pair of feed rollers 14 for feeding paper upon which indicia are to be copied (hereinafter referred to as copy paper) from an original document by a conventional dry particle fusion process. The reproducing apparatus 10 further includes a suitable feed roller 16 which functions to feed the original document to a location within the apparatus from which an image is projected corresponding to the indicia carried by the original for purposes of transfer to the copy paper. In FIG. 1, an elongated strip-type sheet of paper upon which the copied indicia is to be placed is shown in dashed lines and is designated generally by reference numeral 20, and elongated original documents are shown in dashed lines, and are designated by reference numeral 22. It will be noted that the original documents 22 are being fed from a fanfold configuration in which a plurality of layers of the documents are formed by folding each of them about a plurality of longitudinally spaced, transversely extending fold lines.

Figure 2:
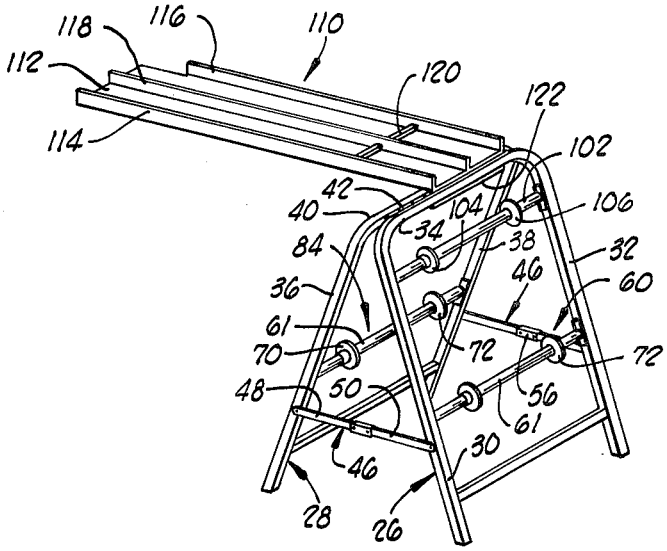
FIG. 2 is a perspective view of a device for feeding concurrently two elongated strips of paper, one an original and the other paper upon which indicia is to be copied, to a reproducing machine in accordance with the present invention.

The feeding device 12 includes a vertically extending collapsible A-frame which, as shown in FIG. 2, includes a pair of opposed, generally U-shaped sides 26 and 28. The U-shaped side 26 includes a pair of opposed, substantially parallel legs 30 and 32 which are interconnected at their upper ends by the horizontally extending web or bight portion 34. In similar fashion, the U-shaped side 28 includes a pair of parallel legs 36 and 38 which are interconnected at their upper ends by a horizontally extending web or bight portion 40. The U-shaped sides 26 and 28 are pivotally interconnected at their upper ends by a hinge 42 which interconnects the web portions 34 and 40 at a location near the ends thereof on one side of the A-frame. The interconnection by means of the hinge 42 is such that a space or gap exists between the remaining portions of the webs 34 and 40 for a purpose hereinafter described.

The U-shaped sides 26 and 28 of the A-frame are illustrated in their expanded, operative positions in which the lower portions of the two sides diverge from each other and are retained in their spatial relationship by means of a pair of horizontally extending, substantially parallel folding linkages 46. Each of the folding linkages 46 includes a pair of straps 48 and 50, with one end of each of the straps connected to one of the legs of each of said U-shaped sides 26 and 28. The two straps 48 and 50 in each linkage 46 are interconnected at their inner ends by means of a U-shaped or channel coupling 56. The straps 48 and 50 can each pivot upwardly from the position of expansion illustrated, and into a relationship to each other, within each of the linkages 46 where the straps define an acute angle at the location where they are interconnected by the coupling. This type of folding linkage is similar to that which is used in a step-ladder for permitting the legs of the ladder to be divergently opened with respect to each other, and ultimately locked in their open or expanded position.

For the purpose of supporting a roll of copy paper which is to be continuously fed to the reproducing apparatus 10, and used to receive on its surface the indicia copied from an original document, a roll-supporting element 60 extends horizontally between the legs 30 and 32 of the U-shaped side 28 of the A-frame. The roll-supporting element 60 includes an elongated cylindrical tubular element or rod 61 which has one end inserted in a slot 62 formed in a plate 64 secured to the inner side of the leg 30, and its opposite end inserted in a generally circular receiving cavity 66 formed in the center of a plate 68 secured to the inner side of the leg 32.

Figure 7:
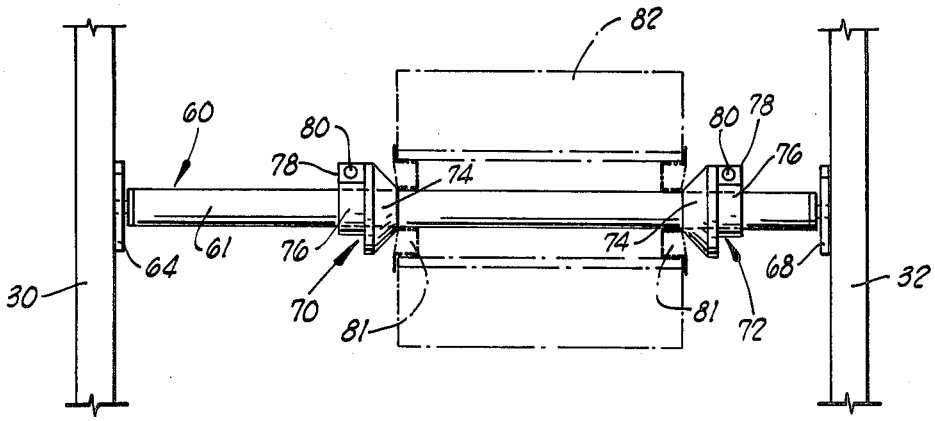
FIG. 7 is a view in elevation of a roll-supporting element forming a portion of the present invention, and illustrating in dashed lines, a paper roll as it is supported thereon for feeding to a reproducing apparatus.

Slidably mounted upon the cylindrical rod 61 for longitudinal sliding movement therealong are a pair of roll-engaging collars 70 and 72 which are best illustrated in FIG. 7 of the drawings. Each of the collars 70 and 72 includes a frusto-conically shaped hub 74 secured to a short cylindrical sleeve 76 which is transversely split to permit its radial expansion and contraction, and which carries at the ends of the sleeve adjacent the split therethrough, a pair of clamping flanges 78. The clamping flanges 78 in each pair of each of the sleeves 76 carry aligned apertures 80 through which a tightening bolt can be extended for engagement with a nut, and used for drawing the flanges toward each other. The sleeves 76 are thus clamped about the cylindrical rod 61 after the time when the frusto-conical hubs 74 of the respective collars have been inserted into, and frictionally engaged with, core plugs 81 closing the opposite ends of a cardboard core tube forming a central core upon which the roll of copy paper is mounted. Such roll is illustrated in dashed lines in FIG. 7 and in full lines in FIG. 1, and is designated generally by reference numeral 82.

A storage roll supporting element 84 identical to the roll supporting element 60 is rotatably mounted between the legs 36 and 38 on the side 28 of the A-frame. The storage roll supporting element 84 includes an elongated tubular element 61 having mounting pins at its opposite ends, which mounting pins are inserted, respectively, in a slot formed in a plate 90 secured to the inner side of the leg 38 of the U-shaped side 28 of the A-frame, and a circular cavity formed in a plate 94 secured to the inner side of the other leg 30 of the U-shaped side 26 of the A-frame. The elongated tubular element 61 of the storage roll supporting element 84 is used for supporting a stand-by or storage roll 96 of copy paper as illustrated in FIG. 1, and for this purpose, also carries a pair of roll-engaging collars 98 and 100 which function to engage the storage roll of copy paper in the same manner as is characteristic of the roll-engaging collars 70 and 72 hereinbefore described.

A paper guiding element, which can be an elongated tubular element 102 identical to the tubular element 86, is mounted between the legs 30 and 32 above the roll supporting element 60, and in cooperation with a pair of collars 104 and 106 slidably and adjustably mounted thereon, functions to guide the copy paper from the copy paper roll 82 into a path such that it can most easily be fed into the reproducing machine 10.

A paper feed tray or document supporting tray 110 is used for supporting and feeding to the reproducing machine 10, one or a pair of documents 22 from which indicia are to be copied. Such paper feed tray 110 is an elongated, double channeled structure which is made up of a base plate 112 having a pair of side flanges 114 and 116 secured to the opposite longitudinal side edges thereof and projecting vertically therefrom. There is also included in the paper feed tray 110 a central divider flange 118 which extends over the length of the tray, and projects vertically from the base plate 112. It will be noted in referring to FIG. 2 that the side flange 116 is terminated short of the end of the base plate 112 or, stated differently, is of substantially lesser length than the base plate, whereas the side flange 114 is co-extensive in length with the base plate. A transversely extending stop rib 120 extends across the base plate 112 between the side flanges 114 and 116 at a location which is spaced inwardly from the end of the paper feed tray 110. At the end of the paper feed tray 110 which is nearest the stop rib 120, a downwardly depending mounting flange 122 is secured to the underside of the base plate 112 and projects vertically downwardly therefrom.

Figure 3:
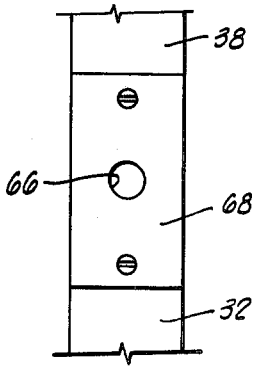
FIG. 3 is a plan view of the system illustrated in FIG. 1.
Figure 5:
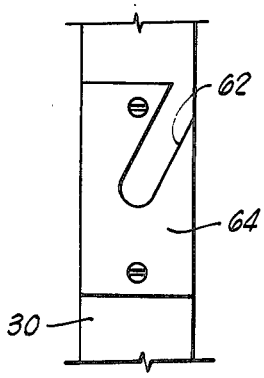
FIG. 5 is a detail view illustrating a receiving cavity used for receiving a paper-supporting element in the present invention.
Figure 3:
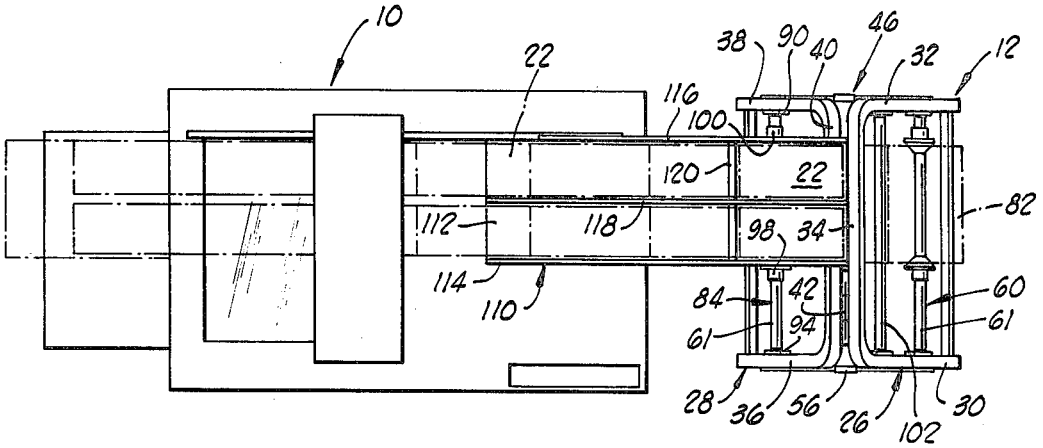
Figure 4:
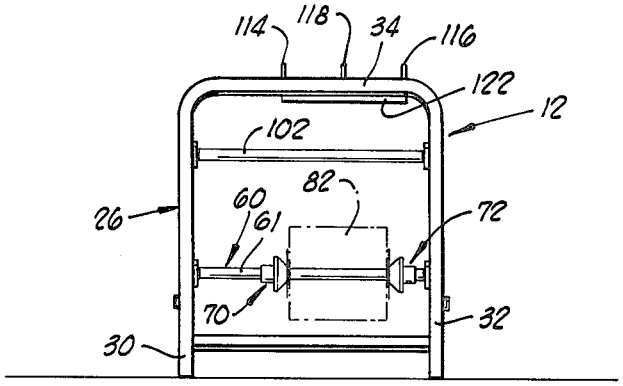
FIG. 4 is an end elevation view of the apparatus illustrated in FIG. 1.

In the use of the apparatus of the invention, the paper feed tray 110 is mounted at the upper side of the A-frame so that the mounting flange 122 projects downwardly into the gap or space which exists between the web portions 34 and 40 at the top of each of the U-shaped sides 26 and 28, and is laterally offset from the hinge 42. This location is best illustrated in FIGS. 2 and 3. The opposite end of the paper feed tray 110 from that which is engaged with the A-frame rests upon the upper side of the reproducing machine, with the end upon this machine terminating or being located in close proximity to the feed roller 16. A pair of original documents 22 which are to be copied are shown positioned upon the paper feed tray in FIGS. 1 and 3 and, in the illustrated use of the invention, are fan fold documents which each include a plurality of superimposed layers which are pulled out and into the copying machine by the feed roller 16 as copying proceeds. It will be noted that the fan-folded original documents 22 occupy the side-by-side channels which are defined by the several side and central flanges 114–118 forming a part of the paper feed tray 110. Typically, documents of this size and configuration which are frequently produced in fan fold form are well logs which graphically portray certain information or data obtained in evaluating certain characteristics of an oil or gas well drilling operation.

Concurrently and synchronously with the feeding of the original documents 22 from the feed tray 110, the copy paper 20 is fed through the reproducing apparatus 10 to a location beneath a reproducing station where indicia is transferred to the surface of the copy paper. The length of the copy paper 20 is such that it will be at least coextensive in length with the original documents, and can be sized transversely to correspond substantially precisely to the documents to be copied. It will be apparent, of course, that the stand-by roll or storage roll 96 is readily available when the roll 82 of copy paper 20 is depleted.

It is also possible by the use of the present invention to feed only a single strip-type original document to the reproducing apparatus 10, and to copy the indicia therefrom upon a relatively broad sheet of elongated copy paper. This can be accomplished by the use of only a single one of the channels formed in the paper feed tray 110.

After copying elongated documents by the use of the document feeding device 12 has been completed, this device can be removed and stored. This is accomplished by initially lifting up the paper feed tray 110 so that the mounting flange 122 is removed from its location between the web portions 34 and 40 of the A-frame. The A-frame is then folded by collapsing the folding linkages 46 upwardly to bring the straps 48 and 50 of each into close proximity to each other, and to cause the lower ends of the two sides of the A-frame to move in close to each other. The legs 30 and 32 of the side 26 of the A-frame are thus moved into parallelism with the legs 36 and 38 of the side 28 thereof. The A-frame is thus caused to occupy a compact status in which it can be stored in a very small or confined location with the feed tray 110 extending alongside and parallel to the sides of the A-frame.

From the foregoing description of the invention, it will be apparent that the invention provides a very useful and easily manufactured device for concurrently feeding elongated original documents and equivalent sized copy paper to a reproducing apparatus. Although a preferred embodiment of the invention has been herein illustrated, it will be understood that various changes in the structure can be effected without departure from the basic principles underlying the invention. Changes such as these are therefore intended to lie within the spirit and scope of the invention, unless the same are necessarily excluded by the language of the appended claims or reasonable equivalents thereof.

What is claimed is:

1. An apparatus for feeding and copying elongated documents comprising:

a reproducing machine;

a vertically extending A-frame having a pair of opposed sides hingedly connected to each other for pivotation from a substantially parallel status to a divergent status;

a roll supporting element mounted on one side of said A-frame for rollably supporting a roll of copy paper on the A-frame;

means on the A-frame for guiding copy paper from a roll of copy paper on the A-frame into said reproducing machine; and a paper feed tray having an end detachably connected to the upper end of said A-frame and an end supported on said reproducing machine for feeding elongated indicia-carrying documents to said reproducing machine at a location above the location at which said copy paper is fed into said reproducing machine.

2. An apparatus as defined in claim 1 wherein each of the sides of said A-frame is U-shaped in configuration and includes:

a pair of substantially parallel legs; and a web interconnecting the legs and located at the top of the A-frame, said webs of the sides of the A-frame being hingedly interconnected to each other.

3. An apparatus as defined in claim 1 wherein said reproducing machine is a xerographic copying machine including a first feed roller for feeding an original document to be copied to a first copying station within the upper portion of the reproducing machine; and at least one feed roller for feeding copy paper to a second copying station disposed below the first copying station within the reproducing machine.

4. An apparatus as defined in claim 1 wherein said roll supporting element comprises elongated roll supporting means having its opposite ends detachably connected to said one side of said A-frame; and a pair of roll-engaging collars slidably mounted on the roll supporting means and selectively positionable therealong for engagement with the opposite ends of a roll of copy paper carried on said roll supporting means.

5. An apparatus as defined in claim 1 wherein said paper feed tray comprises:

an elongated base plate having opposed, longitudinal side edges and end edges;

a mounting flange secured to one end edge of said elongated base plate and projecting between the opposed sides of the A-frame at the top of the A-frame; and a pair of side flanges secured along the longitudinal side edges of the base plate.

6. An apparatus as defined in claim 1 wherein said means on the A-frame for guiding copy paper comprises an elongated tubular element having its opposite ends detachably connected to one side of said A-frame.

7. An apparatus as defined in claim 5 wherein said paper feed tray is further characterized in including a central divider flange extending over the length of the tray midway between said side flanges; and a transversely extending stop rib extending across said tray from one of said side flanges to the other and projecting from said base plate, said stop rib being spaced from said end edge of said base plate.

8. An apparatus as defined in claim 1 and further characterized as including a storage roll supporting element mounted on the opposite side of said A-frame from the side thereof in which said roll-supporting element is mounted.

9. An apparatus as defined in claim 2 wherein said webs of the sides of the A-frame are horizontally spaced to receive a portion of said paper feed tray, and said A-frame further includes a hinge extending across the space between the webs and interconnecting the webs.

10. An apparatus as defined in claim 2 wherein said reproducing machine is a xerographic copying machine including a first feed roller for feeding an original document to be copied to a first copying station within the upper portion of the reproducing machine; and at least one feed roller for feeding copy paper to a second copying station disposed below the first copying station within the reproducing machine.

11. An apparatus as defined in claim 2 wherein said roll supporting element comprises:

elongated roll supporting means having its opposite ends detachably connected to said one side of said A-frame; and a pair of roll-engaging collars slidably mounted on the roll supporting means and selectively positionable therealong for engagement with the opposite ends of a roll of copy paper carried on said roll supporting means.

12. An apparatus as defined in claim 11 wherein each of said roll-engaging collars comprises:

a frusto-conically shaped hub;

a cylindrical, transversely split sleeve coaxially secured to the base side of said frusto-conically shaped hub; and a pair of apertured clamping flanges carried on said split sleeve on opposite sides of the split therein and facing each other with the apertures therein aligned to facilitate contracting said split sleeve around said elongated roll supporting means when fastening devices are extended through said aligned apertures and tightened.

13. An apparatus as defined in claim 12 wherein said paper feed tray comprises:

an elongated base plate having opposed, longitudinal side edges and end edges;

a mounting flange secured to one end edge of said elongated base plate and projecting between the opposed sides of the A-frame at the top of the A-frame; and a pair of side flanges secured along the longitudinal side edges of the base plate.

14. An apparatus as defined in claim 13 wherein said reproducing machine includes:

a first feed roller for feeding an original document to be copied to a first copying station within the upper portion of the reproducing machine; and at least one feed roller for feeding copy paper to a second copying station disposed below the first copying station within the reproducing machine.

15. An apparatus for concurrently feeding an elongated original document to a copying machine comprising:

a foldable A-frame which includes a plurality of pairs of legs hingedly interconnected for folding from an operative, divergent status defining an acute angle between leg pairs to a collapsed storage status in which the legs in each pair extend substantially parallel to each other;

a roll supporting rod detachably mounted on one of said pair of legs; and a pair of roll-engaging collars mounted on said rod; and a paper feed tray including a mounting flange detachably connected to said A-frame;

an elongated base plate extending from said mounting flange outwardly from said A-frame; and means for guiding an unfolding fan-fold document supported on said base plate along said base plate to an end of the base plate remote from the mounting flange.

* * * * *